US005598702A

United States Patent [19]

Uchikawa

[11] Patent Number: 5,598,702

[45] Date of Patent: Feb. 4, 1997

[54] METHOD AND APPARATUS FOR CONTROLLING THE AIR-FUEL RATIO OF AN INTERNAL COMBUSTION ENGINE

[75] Inventor: Akira Uchikawa, Atsugi, Japan

[73] Assignee: Unisia Jecs Corporation, Atsugi, Japan

[21] Appl. No.: 389,829

[22] Filed: Feb. 16, 1995

[30] Foreign Application Priority Data

Feb. 17, 1994 [JP] Japan ..... 6-019720

[51] Int. Cl.[6] ..... F01N 3/18

[52] U.S. Cl. ..... 60/274; 60/284; 60/285; 123/674; 123/691

[58] Field of Search ..... 60/274, 276, 284, 60/285; 123/674, 691

[56] References Cited

U.S. PATENT DOCUMENTS

| | | | |
|---|---|---|---|
| 5,255,512 | 10/1993 | Hamburg et al. | 123/674 |
| 5,303,548 | 4/1994 | Shimizu et al. | 60/285 |
| 5,311,737 | 5/1994 | Komatsu et al. | 123/674 |
| 5,483,946 | 1/1996 | Hamburg et al. | 123/674 |
| 5,490,381 | 2/1996 | Becker | 60/284 |

FOREIGN PATENT DOCUMENTS

| | | |
|---|---|---|
| 58-48756 | 3/1983 | Japan . |
| 60-240840 | 11/1985 | Japan . |
| 63-97851 | 4/1988 | Japan . |

*Primary Examiner*—Leonard E. Heyman
*Attorney, Agent, or Firm*—Foley & Lardner

[57] ABSTRACT

In a device having air-fuel ratio sensors upstream and downstream of an exhaust gas purifying catalytic converter with learning carried out based on output values from the downstream air-fuel ratio sensor, independent learning is carried out depending on whether the catalytic converter is active or not. The air-fuel ratio is then controlled based on the output value of the first air-fuel ratio sensor, the output value of the second air-fuel ratio sensor and the learned value. As a result leaning accuracy is increased and air-fuel ratio control performance enhanced.

12 Claims, 6 Drawing Sheets

METHOD AND APPARATUS FOR CONTROLLING THE AIR-FUEL RATIO OF AN INTERNAL COMBUSTION ENGINE

FIELD OF THE INVENTION

The present invention relates to a method and apparatus for controlling the air-fuel ratio of an internal combustion engine, and in particular to a method and apparatus for precisely controlling the air-fuel ratio according to feedback control carried out based on values detected by two air-fuel ratio sensors disposed on upstream and downstream sides respectively of an exhaust gas purifying catalytic converter arranged in an exhaust system.

DESCRIPTION OF THE RELATED ART

A conventional type of air-fuel ratio control apparatus for an internal combustion engine is disclosed for example in Japanese Unexamined Patent Publication No. 60-240840.

With this apparatus, a basic fuel supply quantity Tp which corresponds to the air quantity drawn into the cylinder is computed by detecting the engine intake air quantity Q and rotational speed N ($Tp=K\times Q/N$; where K is a constant) and the basic fuel supply quantity Tp is corrected with engine temperature and the like. Feedback correction is then carried out on the corrected basic fuel supply quantity Tp using an air-fuel ratio feedback correction coefficient (air-fuel ratio correction quantity) which is set according to signals from an air-fuel ratio sensor (oxygen sensor) which detects the air-fuel ratio of the mixture by detection of the concentration of oxygen in the exhaust. Correction with battery voltage and the like is also carried out, thereby giving a resultant fuel supply quantity Ti.

A drive pulse signal having a pulse width corresponding to the set fuel supply quantity Ti is then output at a set timing to fuel injection valves, to inject a predetermined quantity of fuel into the engine.

The abovementioned air-fuel ratio feedback correction based on the signals from the air-fuel ratio sensor is effected so as to keep the air-fuel ratio close to the target air-fuel ratio (stoichiometric air-fuel ratio). This is because the converting efficiency (purifying efficiency) of the exhaust gas purifying catalytic converter (three way catalytic converter) disposed in the exhaust system for purifying the exhaust gases by reducing the NOx and oxidizing the CO and HC present therein, is set to function most effectively with exhaust conditions for stoichiometric air-fuel ratio combustion.

Since the electromotive force (output voltage) generated by such an air-fuel ratio sensor has the characteristic of changing rapidly in the vicinity of the stoichiometric air-fuel ratio, the mixture air-fuel ratio can be judged to be richer or leaner than the stoichiometric air-fuel ratio by comparing the output voltage Vo with a reference voltage (slice level) SL corresponding to the stoichiometric air-fuel ratio. Then when for example the air-fuel ratio is lean (rich), a feedback correction coefficient $\alpha$ by which the basic fuel supply quantity Tp is multiplied, is increased (decreased) by a large proportional constant P at the time of a first shift to lean (rich), and thereafter, is gradually increased (decreased) by a predetermined integral portion I to thereby increment (decrement) the fuel supply quantity Ti to keep the air-fuel ratio close to the stoichiometric air-fuel ratio.

With this standard type of air-fuel ratio feedback control apparatus, to ensure good response, the single air-fuel ratio sensor is disposed at a collecting portion of the exhaust manifold as close as possible to the combustion chamber. However, since the exhaust temperature in this region is high, there is the likelihood of changes in the sensor characteristics due to the thermal influence and consequent deterioration thereof. Moreover, since the mixture of the exhaust for each of the cylinders is not sufficiently mixed in this region, mean air-fuel ratio detection of all of the cylinders becomes difficult. Accordingly air-fuel ratio detection accuracy is compromised with a consequent deterioration in air-fuel ratio control accuracy.

In view of the above it has been proposed to arrange another air-fuel ratio sensor on the downstream side of the catalytic converter in addition to the one disposed on the upstream side thereof, and carry out air-fuel ratio feedback control using values detected by the two air-fuel ratio sensors (Japanese Unexamined Patent Publication No. 58-48756).

Although the downstream air-fuel ratio sensor is not advantageous in terms of responsiveness due to its distance from the combustion chamber, because it is downstream of the exhaust gas purifying catalytic converter, it is less affected by the rate of the exhaust components (CO, HC, NOx, $CO_2$ etc.), and since the toxicity amount from the toxic components in the exhaust gas is less, then characteristic changes due to toxicity are less likely. Moreover, since it receives a well mixed exhaust, it can detect the mean air-fuel ratio of all of the cylinders. As a result the downstream air-fuel ratio sensor provides more accurate and stabilized detection compared with that provided by the upstream air-fuel ratio sensor.

With this arrangement, the two air-fuel ratio feedback correction coefficients which are respectively set by computation such as described above based on the detected values of the two air-fuel ratio sensors are combined together, or a control constant (proportional portion or integral portion) for the air-fuel ratio feedback correction coefficient set by means of the upstream air-fuel ratio sensor, or a reference voltage and delay time for the output voltage of the upstream air-fuel ratio sensor is corrected. The fluctuations in output characteristics of the upstream air-fuel ratio sensor can thus be compensated for by the downstream air-fuel ratio sensor, enabling precise air-fuel ratio feedback control to be carried out.

With the air-fuel ratio control apparatus using two air-fuel ratio sensors as described above however, the required level for air-fuel ratio correction during feedback control is significantly different from that during non feedback control, so that particularly at the start of feedback control when switching from non feedback control to feedback control, the following problems occur.

In the above case, the speed of feedback control using the downstream air-fuel ratio sensor is usually set to be slower than that using the upstream air-fuel ratio sensor. As a result it takes time for an air-fuel ratio correction quantity controlled by the feedback control using the downstream air-fuel ratio sensor (for example the correction quantity for the proportional amount of the correction coefficient for the air-fuel ratio feedback control using the upstream air-fuel ratio sensor) to reach a required value. This extends the time required for attaining a target air-fuel ratio, deteriorating fuel consumption, operability, and the exhaust gas emissions.

Moreover, when an operating condition of the engine is shifted from one operation region to a different one during the air-fuel ratio feedback control, the air-fuel ratio may greatly deviate from a target air-fuel ratio due to the difference of required levels for air-fuel ratio correction between the operation regions. This also deteriorates fuel consumption, operability, and the exhaust gas emissions.

It has thus been proposed to continuously calculate the mean values of the second air-fuel ratio correction quantities as learned correction values and store these for each operation region. The fuel supply quantity is then corrected and set using the learned correction values so as to maintain stable control of the air-fuel ratio (Japanese Unexamined Patent Publication No. 63-97851).

With this arrangement however, since the three way catalytic converter is inactive during warm up to a predetermined temperature, its potential purifying capacity is not realized. Therefore in the pre-activation period, the exhaust gas flows to the downstream air-fuel ratio sensor without being sufficiently purified by the catalytic converter.

That is to say, during this period the exhaust gas HC concentration is higher and the NOx concentration lower compared to when the catalytic converter is activated.

Therefore, during the period until the catalytic converter is activated, the output characteristics of the downstream air-fuel ratio sensor also show an increase in lean time output.

However with the arrangement involving continuously calculating the mean values of the second air-fuel ratio correction quantities as learned correction values and then correcting and setting the fuel supply quantity using the learned correction values, if the fuel supply quantity is corrected and set using learned correction values the same as those for when the catalytic converter is active when the catalytic converter is in an inactive condition, since the output characteristics of the downstream air-fuel ratio sensor will differ from that for when the catalytic converter is active, learning accuracy cannot be maintained, resulting in a deterioration in the exhaust emission performance.

SUMMARY OF THE INVENTION

In view of the foregoing, it is an object of the present invention to determine the active and inactive conditions of the exhaust gas purifying catalytic converter so that even if inactive, an appropriate learned correction value can be set, thereby maintaining learning accuracy and thus keeping unfavorable conditions such as deterioration in exhaust emission performance to a minimum.

It is therefore an object of the present invention to maintain the learning accuracy using independently stored learned correction values for the active and the inactive condition of the exhaust gas purifying catalytic converter.

It is a further object of the present invention to maintain the learning accuracy using learned correction values obtained by modifying reference values used learning with the active and inactive conditions of the exhaust gas purifying catalytic converter.

It is an even further object of the present invention to be able to easily and accurately judge if the exhaust gas purifying catalytic converter is in an active or inactive condition, based on output conditions of the down stream air-fuel ratio sensor.

To achieve the above objectives, a first method and apparatus for controlling the air-fuel ratio of an internal combustion engine according to the present invention, includes as shown in FIG. 1(A);

a first air-fuel ratio detection step or device for detecting air-fuel ratio using a first air-fuel ratio sensor the output value of which changes in response to the concentration of specific gaseous components in an exhaust gas, the concentration changing with air-fuel ratio in an exhaust passage upstream of an exhaust gas purifying catalyst device provided in the exhaust passage of the internal combustion engine, a second air-fuel ratio detection step or device for detecting air-fuel ratio using a second air-fuel ratio sensor the output value of which changes in response to the concentration of specific gaseous components in an exhaust gas, the concentration changing with air-fuel ratio in an exhaust passage downstream of the exhaust gas purifying catalyst device, a first air-fuel ratio correction quantity computation step or device for computing a first air-fuel ratio correction quantity corresponding to an output value from the first air-fuel ratio sensor, a learned correction value computation step or device for updating a learned correction value, based on a comparison of an output value from the second air-fuel ratio sensor and a reference value, a second air-fuel ratio correction quantity computation step or device for computing a second air-fuel ratio correction quantity corresponding to the output value from the second air-fuel ratio sensor, and the learned correction value, an air-fuel ratio correction quantity computation step or device for computing a resultant air-fuel ratio correction quantity based on the first air-fuel ratio correction quantity and the second air-fuel ratio correction quantity, a catalytic converter condition judgement step or device for determining if the exhaust gas purifying catalytic converter is in an active condition, a learned correction value storage control step or device for storing the learned correction value for each operation region in a catalytic converter inactive storage device, when judged by the catalytic converter condition judgement step or device that the exhaust gas purifying catalytic converter is not in an active condition, and for storing the learned correction value for each operation region in a catalytic converter active storage device, when judged by the catalytic converter condition judgement step or device that the exhaust gas purifying catalytic converter is in an active condition, and a learned correction value selection step or device for selecting as a learned correction value for use in the second air-fuel ratio correction quantity computation step or device, a learned correction value stored in the catalytic converter inactive storage device, when judged by the catalytic converter condition judgement step or device that the exhaust gas purifying catalytic converter is not in an active condition, or a learned correction value stored in the catalytic converter active storage device, when judged by the catalytic converter condition judgement step or device that the exhaust gas purifying catalytic converter is in an active condition.

With the above construction, the first air-fuel ratio correction quantity computation step or device computes the first air-fuel ratio correction quantity based on the output value from the first air-fuel ratio sensor, while the second air-fuel ratio correction quantity computation step or device computes the second air-fuel ratio correction quantity based on the output value from the second air-fuel ratio sensor and the learned correction values stored for each operation region.

When the exhaust gas purifying catalytic converter is judged by the catalytic converter condition judgement step or device to be in the inactive condition, the learned correction value is stored in the catalytic converter inactive storage device, while when judged to be in the active condition, it is stored in the catalytic converter active storage device.

Moreover, when setting the second air-fuel ratio correction quantity, either one of the two types of storage devices is selected according to whether the catalytic converter is judged to be in the active or inactive condition, and the looked up learned correction value is used.

By computing a resultant air-fuel ratio correction quantity based on the first air-fuel ratio correction quantity and the second air-fuel ratio correction quantity set in the above manner, so as to control the air-fuel ratio of the internal combustion engine, then learning accuracy can be maintained and deterioration in exhaust emission performance prevented even when the exhaust gas purifying catalytic converter is not in the active condition.

Moreover, a second method and apparatus for controlling the air-fuel ratio of an internal combustion engine according to the present invention, incorporates as shown in FIG. 1(B), in a similar manner to beforehand, a first air-fuel ratio detection step or device, a second air-fuel ratio detection step or device, a first air-fuel ratio correction quantity computation step or device, a learned correction value computation step or device, a second air-fuel ratio correction quantity computation step or device, a catalytic converter condition judgement step or device, and an air-fuel ratio correction quantity computation step or device.

However, the learned correction value storage control step or device includes a reference value modifying step or device for storing the learned correction value for each operating region in one storage device, and for modifying the comparison reference value used in the learned correction value computation step or device, towards the air-fuel ratio rich side when judged by the catalytic converter condition judgement step or device that the exhaust gas purifying catalytic converter is not in an active condition.

With the above construction, when the learned correction value for the operation region corresponding to the learned correction value storage control step or device is updated, this update is based on a comparison of the output value from the second air-fuel ratio sensor with the reference value. However, when the learned correction value for the operation region corresponding to the storage device is updated, the reference value for judging the output value of the second oxygen sensor is modified to the rich side when judged that the exhaust gas purifying catalytic converter is not in an active condition.

Consequently, the change over from rich to lean is sped up, so that it is possible to cope with the change of the lean output attributable to the exhaust gas purifying catalytic converter being in the inactive condition. As a result learning accuracy can be maintained even if the exhaust gas purifying catalytic converter has not attained the active condition.

Moreover, with the above invention, the catalytic converter condition judgement step or device may comprise, a step or device for detecting an output fluctuation range of the second air-fuel ratio sensor, and a step or device for judging if the exhaust gas purifying catalytic converter has attained the active condition, based on the output fluctuation range detected by the output fluctuation range detection step or device.

With such an arrangement, it can be judged it the exhaust gas purifying catalytic converter is in the inactive condition when for example the lean side output is greater than or equal to a predetermined value, based on the lean side output of the downstream second air-fuel ratio sensor detected by the output fluctuation range detection step or device.

Moreover, the catalytic converter condition judgement step or device may judge if the exhaust gas purifying catalytic converter is active, based on an air-fuel ratio lean side output value from the second air-fuel ratio sensor.

With such an arrangement, it can be judged if the exhaust gas purifying catalytic converter is in the inactive condition when for example the output fluctuation range is greater than or equal to a predetermined range, based on the output fluctuation range of the downstream second air-fuel ratio sensor detected by the output fluctuation range detection step or device.

Other objects and aspects of the present invention will become apparent from the following description of embodiments given in conjunction with the appended drawings.

DETAILED DESCRIPTION OF THE PREFERRED EMBODIMENT

As follows is a description of embodiments of the present invention.

Figure 1A:
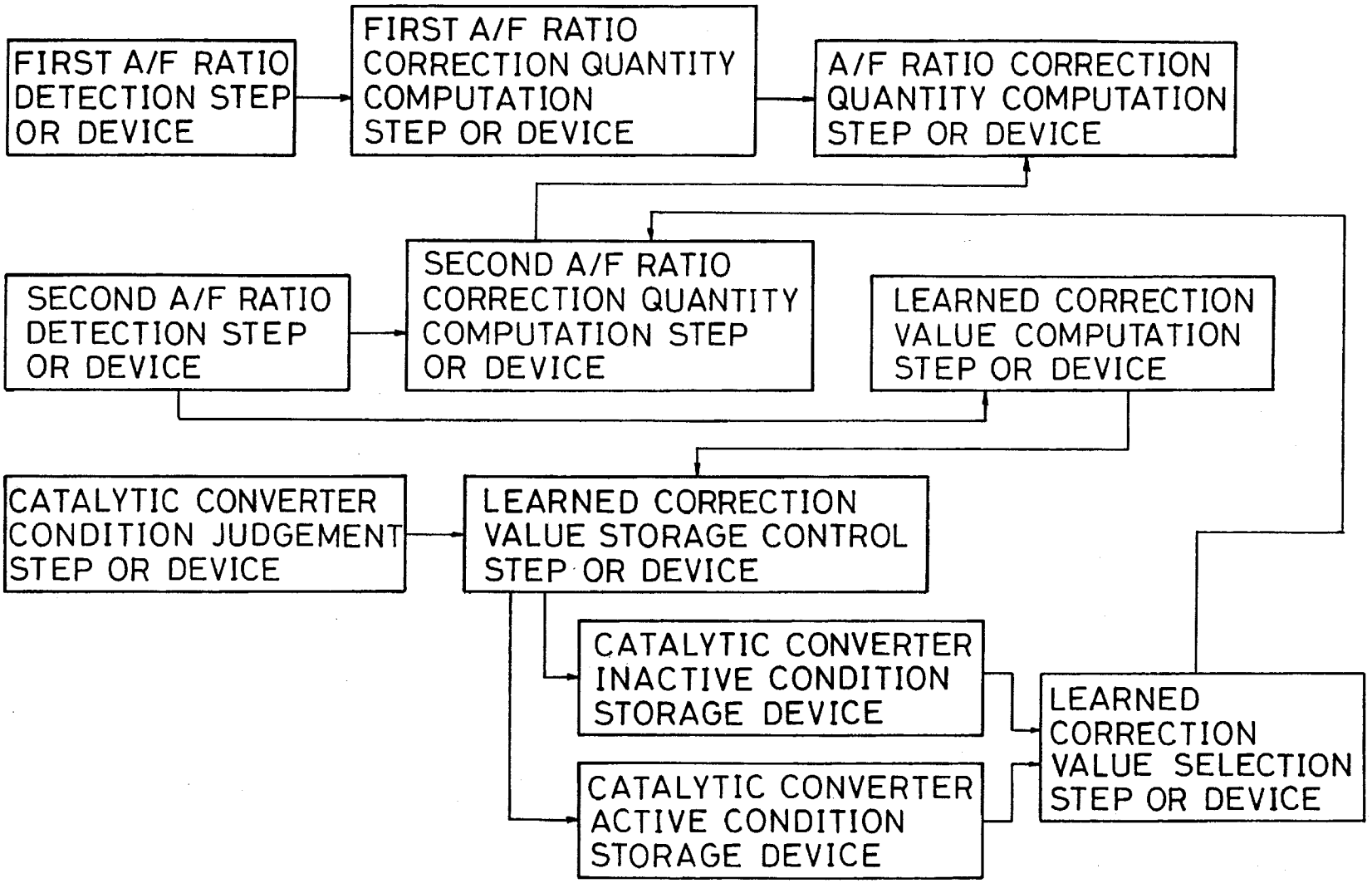
FIGS. 1(A) and (B) are a block diagrams showing constructions of the present invention.
Figure 1B:
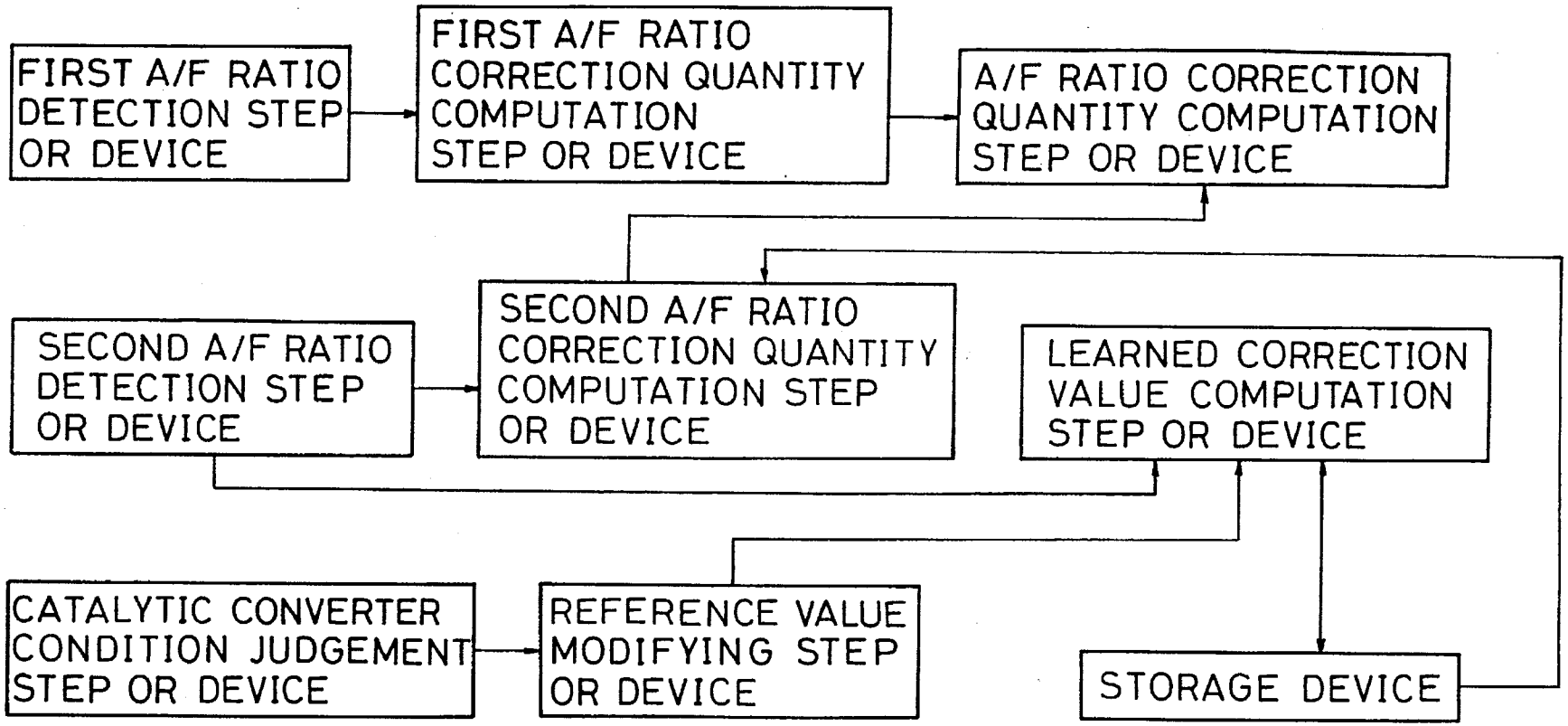
Figure 2:
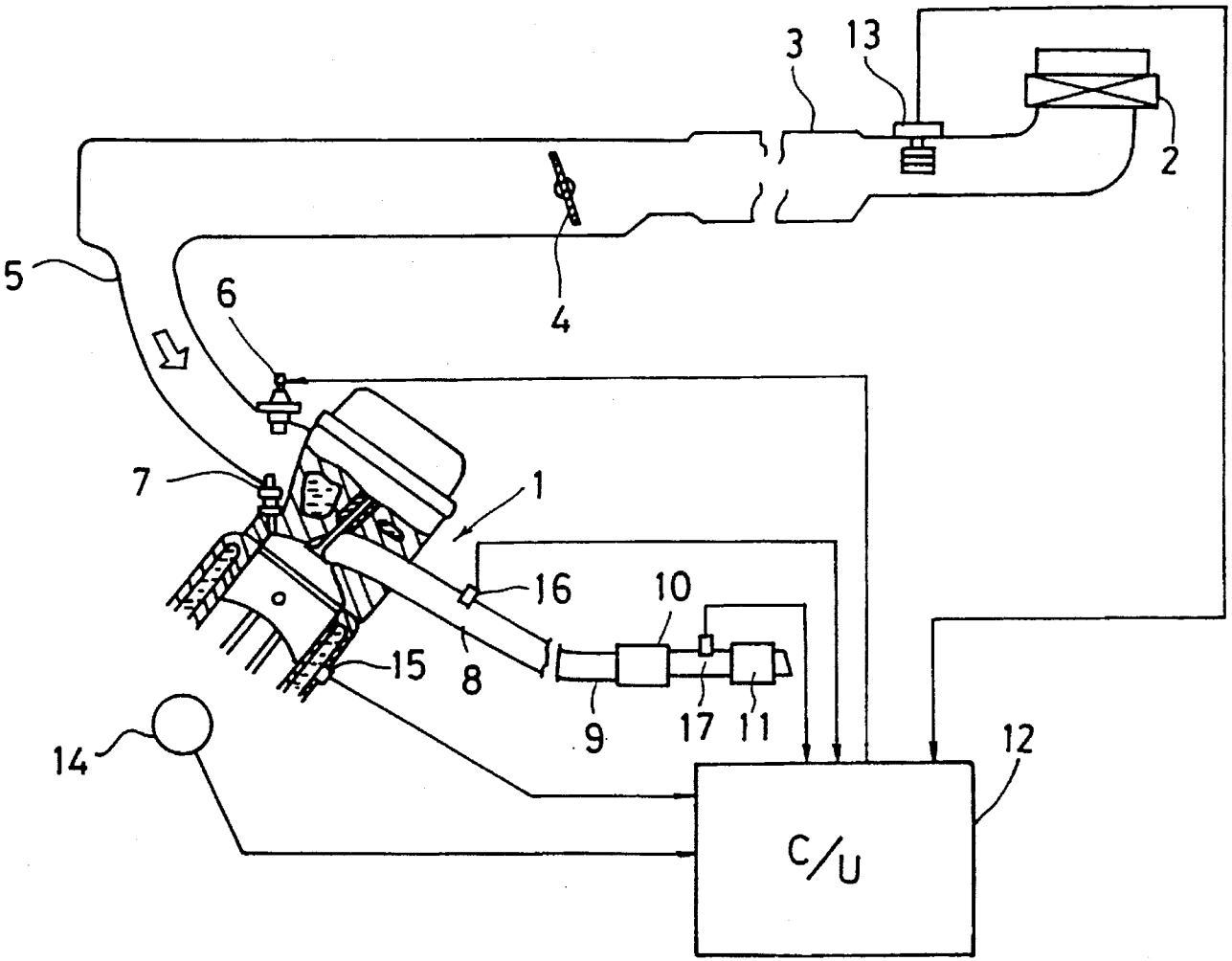
FIG. 2 is a schematic system diagram illustrating embodiments of the present invention.

With the embodiment shown in FIG. 2, an internal combustion engine 1 draws in air from an air cleaner 2 by way of an intake duct 3, a throttle valve 4, and an intake manifold 5.

Fuel injection valves 6 are provided for each cylinder in respective branch portions of the intake manifold 5. The fuel injection valves 6 are electromagnetic type fuel injection valves which open with power to a solenoid and close with power shut-off. The injection valves 6 are driven open in response to an injection pulse signal provided by a control unit 12 (to be described later) so that fuel pressurized by a fuel pump (not shown), and controlled to a predetermined pressure by means of a pressure regulator, is injected to inside the intake manifold 5.

Ignition plugs 7 are provided for each combustion chamber of the engine 1 for spark ignition of a mixture therein.

Exhaust gas from the engine 1 is discharged by way of an exhaust manifold 8, an exhaust duct 9, a three way catalytic converter 10 for exhaust purification (exhaust gas purifying catalytic converter) and a muffler 11. The catalytic converter 10 reduces the NOx and oxidizes the CO and HC present in the exhaust gas, converting them into other harmless substances, with the conversion efficiencies for these reactions being at an optimum when the engine intake mixture is burnt at the stoichiometric air-fuel ratio.

The control unit 12 incorporates a microcomputer having a CPU, ROM, RAM, A/D converter and input/output interface. Detection signals from the various sensors are input to the control unit 12, and computational processing carried out (as described later) to thereby control the operation of the fuel injection valves 6.

For the various sensors there is provided in the intake duct 3, an airflow meter 13 such as a hot wire type or flap type airflow meter, which outputs a voltage signal corresponding to the intake air quantity Q of the engine 1.

Also provided is a crank angle sensor 14 which outputs a reference crank angle signal REF for each predetermined piston position, and a unit crank angle signal POS for each unit crank angle. The period of the reference crank angle signals REF or the number of unit crank angle signals POS within a predetermined period is measured to compute the engine rotational speed Ne.

Moreover, a water temperature sensor 15 is provided for detecting the cooling water temperature Tw in the water jacket of the engine 1.

There is also a first air-fuel ratio sensor 16 provided at a junction portion of the exhaust manifold 8 on the upstream side of the catalytic converter 10, and a second air-fuel ratio sensor 17 provided on the downstream side of the catalytic converter 10 and upstream of the muffler 11.

The first air fuel ratio sensor 16 and the second air-fuel ratio sensor 17 are known sensors whose output values change in response to the concentration of oxygen in the exhaust gas. They are rich/lean sensors which utilize the fact that the concentration of oxygen in the exhaust gas drastically changes around the stoichiometric air-fuel ratio, to detect if the exhaust air-fuel ratio is richer or leaner than the stoichiometric air-fuel ratio.

Figure 3:
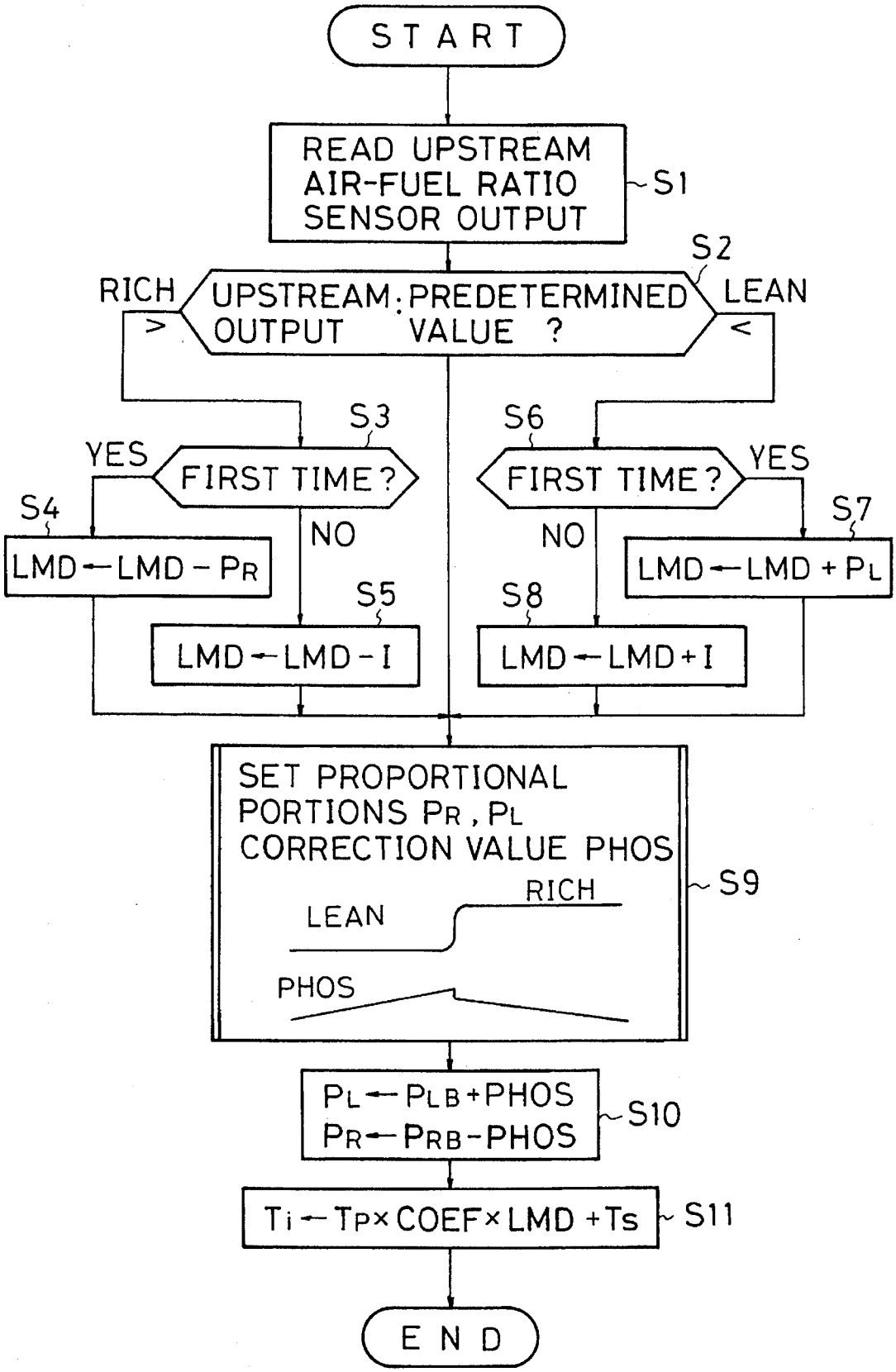
FIG. 3 is a flow chart showing an air-fuel ratio feedback control routine.

When predetermined feedback control conditions are established, the CPU of the microcomputer in the control unit 12 proportional-plus-integral controls an air-fuel ratio feedback correction coefficient LMD according to the flow chart of FIG. 3 so that the outputs of the first and second air-fuel ratio sensors 16, 17 approach values corresponding to the target air-fuel ratio.

In the present embodiment, the functions of the air-fuel ratio correction quantity computation step or device, are realized by software illustrated by the flow chart of FIG. 3 and stored in the control unit 12.

In the flow chart of FIG. 3, initially in step 1 (with "step" denoted by S in the figures), the output voltage of the upstream first air-fuel ratio sensor 16 is read.

Then in step 2, the output voltage read in step 1 is compared with a predetermined value corresponding to the target air-fuel ratio (stoichiometric air-fuel ratio) to judge if the actual air-fuel ratio is richer or leaner than the target air-fuel ratio.

When the output voltage is greater than the predetermined value so that the air-fuel ratio is judged richer, control proceeds to step 3 where it is judged if this is the first rich judgement.

If the first rich judgement, control proceeds to step 4, where a proportional control involving subtracting a proportional portion $P_R$ (set as described later) from the previous air-fuel ratio feedback correction coefficient LMD (originally equal to 1.0) is carried out to update the air-fuel ratio feedback correction coefficient LMD.

When judged in step 3 not to be the first rich judgement, control proceeds to step 5 where integral control involving subtracting a predetermined integral portion I from the previous air-fuel ratio feedback correction coefficient LMD is carried out to update the air-fuel ratio feedback correction coefficient LMD.

This reduction control of the air-fuel ratio feedback correction coefficient LMD corresponds to a correction to reduce the fuel injection quantity Ti. Hence repetition of the integral control in step 5, changes the air-fuel ratio to a lean air-fuel ratio.

When judged in step 2 that the air-fuel ratio has changed over to a lean air-fuel ratio, control proceeds to step 6 where it is judged if this is the first lean judgement.

If the first lean judgement, control proceeds to step 7 where a proportional control involving adding a proportional portion $P_L$ (set as described later) to the previous air-fuel ratio feedback correction coefficient LMD is carried out to update the air-fuel ratio feedback correction coefficient LMD.

When judged not to be the first lean judgement, control proceeds to step 8 where integral control involving adding a predetermined integral portion I to the previous air-fuel ratio feedback correction coefficient LMD is carried out to update the air-fuel ratio feedback correction coefficient LMD.

That is to say the above described steps 2 through 8 effect the function of the first air-fuel ratio correction quantity computation step or device.

In step 9, a correction value PHOS (originally equal to zero) for correcting basic proportional portions $P_{RB}$, $P_{LB}$ is controlled by proportional-plus-integral control based on the output voltage of the second air-fuel ratio sensor 17, in a similar manner to the proportional-plus-integral control of the air-fuel ratio feedback correction coefficient LMD based on the output voltage of the first air-fuel ratio sensor 16, so that the air-fuel ratio detected by the second air-fuel ratio sensor 17 approaches the target air-fuel ratio (stoichiometric air-fuel ratio).

That is to say step 9 effects the function of the second air-fuel ratio correction quantity computation step or device.

Here the correction value PHOS is stored in a map which acts as the storage device for the learned correction values for each operating region. In this map the basic fuel injection amount Tp and the engine rotational speed Ne are respectively divided into two portions giving a total of four divisions. As a construction according to a first aspect of the present invention, the present embodiment has a three way catalytic converter active map, which stores a correction value $PHOS_H$ for when the catalytic converter 10 is active, and a three way catalytic converter inactive map which stores a correction value $PHOS_L$ for when the catalytic converter 10 is inactive. The map to be used is determined by a map selection routine to be described later.

In step 10, the correction value PHOS (that is, $PHOS_H$ or $PHOS_L$) is added to the basic proportional portion $P_{LB}$, and the result set to a proportional portion $P_L$ ($P_L=P_{LB}+PHOS$), and is subtracted from the basic proportional portion $P_{RB}$, and the result set to a proportional portion $P_R$ ($P_R=P_{RB}-PHOS$).

The proportional portion $P_R$ is the proportional portion used in the beforementioned reduction control of the air-fuel ratio feedback correction coefficient LMD at the time of the first rich judgement, while the proportional portion $P_L$ is the proportional portion used in the beforementioned increase control of the air-fuel ratio feedback correction coefficient LMD at the time of the first lean judgement. The correction value PHOS is reducingly set when the second air-fuel ratio sensor 17 senses a rich air-fuel ratio. Hence with a rich air-fuel ratio, control by the proportional portion $P_R$ in the lean direction increases, while control by the proportional portion $P_L$ in the rich direction reduces. The proportional control characteristics of the air-fuel ratio feedback correction coefficient LMD are thus changed in a direction so that the rich air-fuel ratio detected by the second air-fuel ratio sensor 17 approaches the target air-fuel ratio.

The correction value PHOS set using the second air-fuel ratio sensor 17 thus compensates for deviation of the air-fuel ratio control point in the air-fuel ratio feedback control using the detection results of the first air-fuel ratio sensor 16.

Correction control using the detection results of the second air-fuel ratio sensor 17 is not however limited to correction control of the proportional portions $P_R$ and $P_L$. For example, a construction is possible wherein the air-fuel ratio feedback control characteristics are changed by modifying a threshold level used at the time of rich/lean judgement based on the output of the first air-fuel ratio sensor 16, or by altering a forced delay time for execution of the proportional control with respect to rich/lean detection by the first air-fuel ratio sensor 16.

The air-fuel ratio feedback correction coefficient LMD set in the above manner based on the output values of the first air-fuel ratio sensor 16 and the second air-fuel ratio sensor 17 respectively provided upstream and downstream of the catalytic converter 10, is used in the computation of the fuel injection quantity Ti in the next step 11.

That is to say, the computation of the air-fuel ratio feedback correction coefficient LMD corresponds to the air-fuel ratio correction quantity computation step or device.

More specifically, the basic fuel injection quantity Tp is computed based on the intake air quantity Q and the engine rotational speed Ne (Tp=K×Q/Ne: where K is a constant). Also computed are for example various correction coefficients COEF based on operating conditions such as the cooling water temperature Tw, and a voltage correction quantity Ts corresponding to battery voltage. The basic fuel injection quantity Tp is then corrected using for example the air-fuel ratio feedback correction coefficient LMD, the various correction coefficients COEF, and the voltage correction quantity Ts, and the corrected result is set as the resultant fuel injection quantity Ti (Ti=Tp×COEF×LMD+Ts).

The control unit 12 outputs to each fuel injection valve 6 at a predetermined injection timing, an injection pulse signal having a pulse width corresponding to the abovementioned fuel injection quantity Ti, thus controlling the injection quantity for the fuel injection valves 6 to produce a mixture having the target air-fuel ratio.

Figure 4:
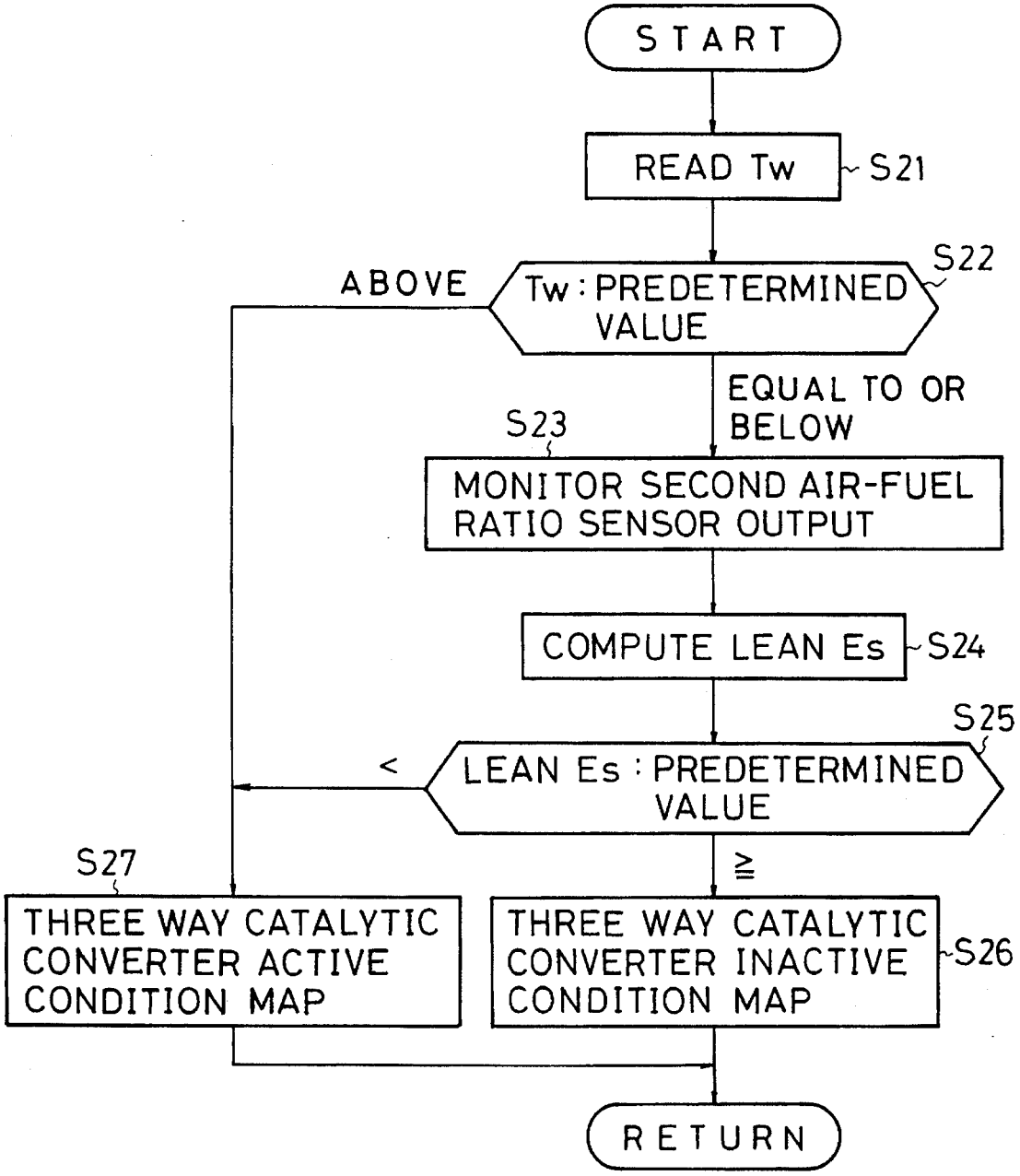
FIG. 4 is a flow chart showing a map selection routine related to a first embodiment of the present invention.

With the present embodiment, the control unit 12 has a map selection routine as illustrated by the flow chart of FIG. 4, which judges if the catalytic converter 10 is in the active or inactive condition, and selects either the catalytic converter active map or the catalytic converter inactive map so that the correction value PHOS read in step 9 is an appropriate value, even if the catalytic converter 10 is inactive.

With the flow chart of FIG. 4 illustrating the map selection routine, initially in step 21, the cooling water temperature Tw is detected by the water temperature sensor 15.

Then in step 22, it is judged if the cooling water temperature Tw is equal to or below a predetermined water temperature. If equal to or below the predetermined temperature, control proceeds to step 23 with the catalytic converter 10 in a low temperature condition. On the other hand if the cooling water temperature Tw is above the predetermined temperature, control proceeds to step 27 with the catalytic converter 10 not in the low temperature condition. Furthermore, the catalytic converter active map is selected so as to use the correction values $PHOS_H$ stored in the catalytic converter active map as correction values PHOS for when the catalytic converter 10 is active.

In step 23, the output voltage of the downstream second air-fuel ratio sensor 17 is monitored.

In step 24 a lean output Lean Es of the second air-fuel ratio sensor 17 is obtained based on the monitoring results in step 23, as the means of the peak values of the electromotive force averaged for example over five cycles.

In step 25, it is judged if the lean output Lean Es obtained in step 24 is greater than or equal to a predetermined value.

Here when the catalytic converter 10 is in a low temperature and inactive condition, it is assumed that the purifying capacity thereof will be insufficient, so that exhaust gases flowing to the second air-fuel ratio sensor 17 during the period until activation will not be sufficiently purified thereby. More specifically, when the catalytic converter 10 is in the inactive condition, its capacity for treating the HC in the exhaust will be lower than when in the active condition so that the amount of HC flowing to the second air-fuel ratio sensor 17 will increase. Also, since the amount of NOx will be less, then the exhaust gases flowing to the second air-fuel ratio sensor 17 will tend to be richer. Therefore, fine lean time output in the output characteristics of the second air-fuel ratio sensor 17 will be higher.

Consequently, when the lean output Lean Es is greater than or equal to the predetermined value it can be determined that the catalytic converter 10 is in an inactive condition.

Moreover, when determined in step 25 that the catalytic converter 10 is in an inactive condition, control proceeds to step 26 to select the catalytic converter inactive map so as to use the correction value $PHOS_L$ stored therein, as the correction value PHOS.

That is to say, the map selection routine incorporates the functions of the output fluctuation range detection step or device, the catalytic converter condition judgement step or device, the learned correction value storage control step or device, and the learned correction value selection step or device. Furthermore, the steps 24 and 25 have a construction in accordance with a third aspect of the present invention.

Accordingly, with the present embodiment, the active or inactive condition of the catalytic converter 10 is determined based on the lean output Lean Es of the second air-fuel ratio sensor 17. When the catalytic converter 10 is in the inactive condition, the three way catalytic converter inactive map is selected and the correction value $PHOS_L$ stored therein is set as the correction value PHOS when updating the air-fuel ratio feedback correction coefficient LMD. The learning accuracy can thus be maintained even if the catalytic converter 10 is in the inactive condition, enabling unfavorable conditions such as deterioration in the exhaust emission performance to be kept to a minimum.

Next is a description of a second embodiment according to the present invention.

Figure 5:
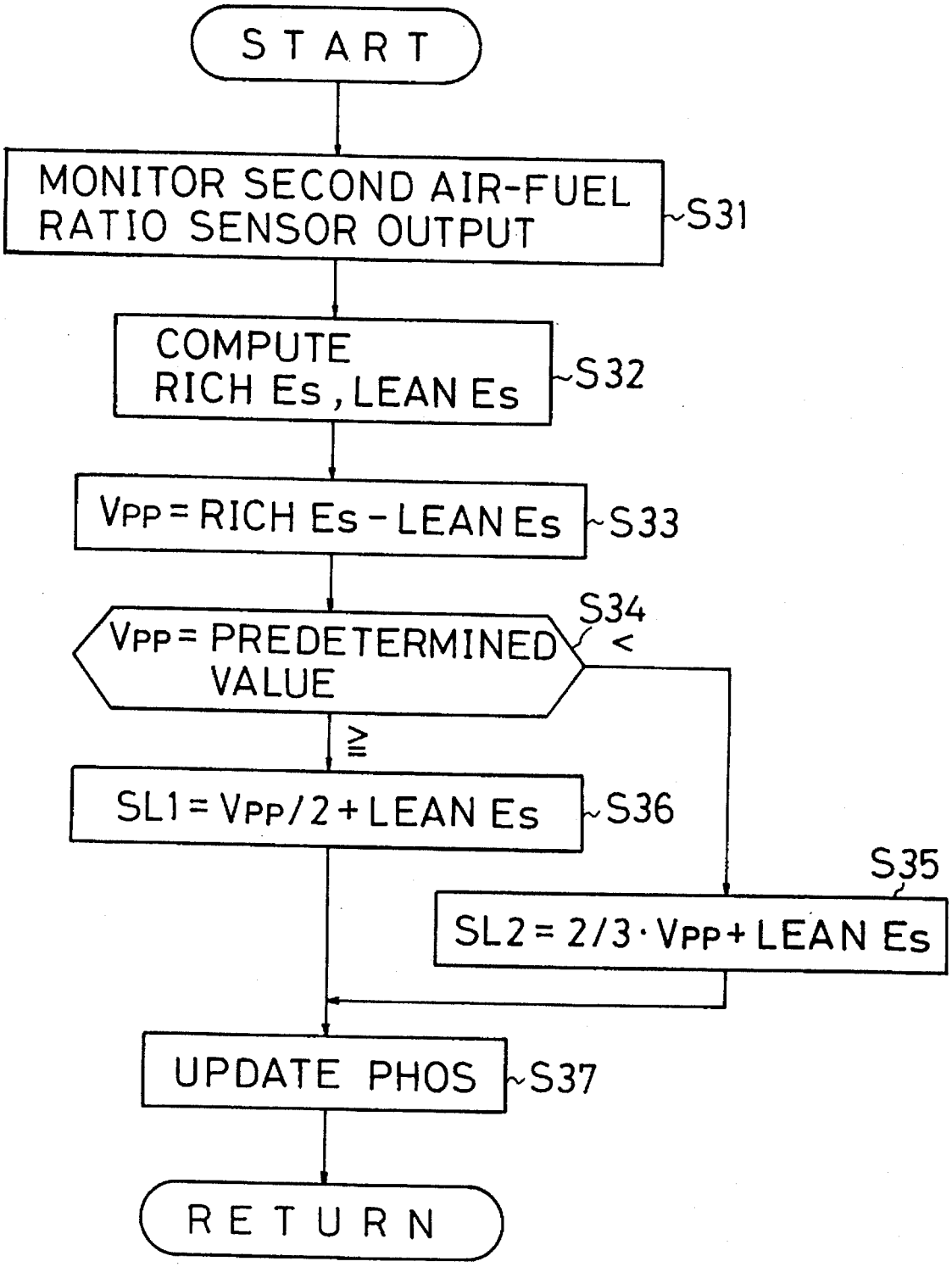
FIG. 5 is a flow chart showing a correction value updating routine related to a second embodiment of the present invention.

In the second embodiment, the control unit 12 has a correction value updating routine as illustrated by the flow chart of FIG. 5, which judges if the catalytic converter 10 is in the active or inactive condition, and updates the correction value PHOS so that the correction value PHOS read in step 9 is an appropriate value, even if the catalytic converter 10 is inactive.

With the flow chart of FIG. 5 illustrating the correction value updating routine, initially in step 31, the output voltage of the downstream second air-fuel ratio sensor 17 is monitored.

Then in step 32, the rich output Rich Es and the lean output Lean Es of the second air-fuel ratio sensor 17 are obtained based on the monitoring results in step 31, as the means of the peak values of the electromotive force averaged for example over five cycles.

In step 33, a deviation Vpp of the rich output Rich Es and the lean output Lean Es obtained in step 32, that is to say the output fluctuation range of the second air-fuel ratio sensor 17, is computed.

Here when the catalytic converter 10 is in a low temperature and inactive condition, it is assumed that the purification capacity thereof will be insufficient, so that exhaust gases flowing to the second air-fuel ratio sensor 17 during the period until activation will not be sufficiently purified thereby. More specifically, when the catalytic converter 10 is in the inactive condition, its capacity for treating the HC in the exhaust will be lower than when in the active condition so that the amount of HC flowing to the second air-fuel ratio sensor 17 will increase. Also, since the amount of NOx will be less, then the exhaust gases flowing to the second air-fuel ratio sensor 17 will tend to be richer. Therefore, the lean output Lean Es in the output characteristics of the second air-fuel ratio sensor 17 will be higher.

Incidentally, since the rich output Rich Es does not change even when the catalytic converter 10 is inactive, the deviation Vpp is small.

Consequently, when the deviation Vpp is less than a predetermined value, it can be determined that the catalytic converter 10 is in an inactive condition, while when the deviation Vpp is greater than or equal to the predetermined value, it can be determined that the catalytic converter 10 is in an active condition.

Therefore, in step 34 it is determined if the deviation Vpp is greater than or equal to the predetermined value or less than the predetermined value, and when the catalytic converter 10 is in the inactive condition (deviation Vpp less than the predetermined value), control proceeds to step 35.

In step 35, a slice level SL which acts as a reference value for being compared with the output value of the second air-fuel ratio sensor 17, is changed according to the following equation.

$$SL2=\tfrac{2}{3}\times Vpp+\text{Lean Es}$$

In this respect, if the slice level SL (reference value) is kept as the normal slice level SL1, since only the lean output Lean Es is increased with the rich output Rich Es unchanged, the time for detecting the rich condition of the air-fuel ratio detected by the second air-fuel ratio sensor 17 is lengthened, so that the change over from rich to lean is excessively delayed. The air-fuel ratio will thus attain a condition similar to that under rich feedback control, so that the activation of the catalytic converter 10 cannot be expedited.

Therefore, a high slice level SL2 is used for the slice level SL to give a lean feedback control thus promoting the change over from rich to lean to set a lean air-fuel ratio. The catalytic converter is thus activated as quickly as possible and also updating accuracy is improved.

On the other hand, in step 34 when determined that the catalytic converter 10 is in the active condition (deviation Vpp greater than or equal to the predetermined value), control proceeds to step 36, where the slice level SL which acts as the reference value for being compared with the output value of the second air-fuel ratio sensor 17, becomes the normal slice level SL1.

$$SL1=\tfrac{1}{2}\times Vpp+\text{Lean Es}$$

Then in step 37, the output value of the second air-fuel ratio sensor 17 is compared with the slice level SL1 or SL2, and the correction value PHOS (originally equal to zero) for correcting the basic proportional portions $P_{RB}$, $P_{LB}$ is updated by the proportional-plus-integral control based on the output voltage of the second air-fuel ratio sensor 17.

In the correction value updating routine, step 33 effects the function of the output fluctuation range detection step or device, step 34 effects the function of the catalytic converter condition judgement device, step 37 effects the function of the learned correction value computation step or device, while steps 35 and 36 effect the function of the reference value modifying step or device.

Furthermore, steps 32, through 34 have a construction in accordance with a fourth aspect of the present invention.

Consequently, with the second embodiment, even with the catalytic converter 10 in the inactive condition with the lean output Lean Es rising, the learning accuracy at the time of updating the correction value PHOS is maintained, enabling unfavorable conditions such as deterioration in the exhaust emission performance to be kept to a minimum.

As described above, with the invention according to the first aspect for an internal combustion engine wherein the air-fuel ratio sensors are respectively provided upstream and downstream of the exhaust gas purifying catalytic converter, and the air-fuel ratio is controlled by computing a resultant air-fuel ratio correction quantity based on the output from these air-fuel ratio sensors, then even if the exhaust gas purifying catalytic converter is inactive, a learned correction value appropriate for the air-fuel ratio control is set and learning accuracy maintained, enabling unfavorable conditions such as deterioration in the exhaust emission performance to be kept to a minimum.

Moreover, with the invention according to the second aspect, the change over from rich to lean is expedited so that it is possible to deal with the change in lean output attributable to the inactive condition of the exhaust gas purifying catalytic converter. Therefore, even when the exhaust gas purifying catalytic converter is not active, learning accuracy is maintained, enabling unfavorable conditions such as deterioration in the exhaust emission performance to be kept to a minimum.

Moreover, with the invention according to the third aspect, the active condition of the exhaust gas purifying catalytic converter is judged based on the lean side output of the second air-fuel ratio sensor, while with the invention according to the fourth aspect, this is based on the output fluctuation range of the second air-fuel ratio sensor. Consequently, the condition of the exhaust gas purifying catalytic converter is reliably determined.

I claim:

1. A method of controlling the air-fuel ratio of an internal combustion engine, said method comprising;

a first air-fuel ratio detection step for detecting air-fuel ratio using a first air-fuel ratio sensor an output value of which changes in response to a concentration of specific gaseous components in an exhaust gas, said concentration changing with air-fuel ratio in an exhaust passage upstream of an exhaust gas purifying catalyst device provided in an exhaust passage of the internal combustion engine, a second air-fuel ratio detection step for detecting air-fuel ratio using a second air-fuel ratio sensor an output value of which changes in response to a concentration of specific gaseous components in an exhaust gas, said concentration changing with air-fuel ratio in an exhaust passage downstream of said exhaust gas purifying catalyst device, a first air-fuel ratio correction quantity computation step for computing a first air-fuel ratio correction quantity corresponding to an output value from said first air-fuel ratio sensor, a learned correction value computation step for updating a learned correction value, based on a comparison of an output value from said second air-fuel ratio sensor and a reference value, a second air-fuel ratio correction quantity computation step for computing a second air-fuel ratio correction quantity corresponding to said output value from said second air-fuel ratio sensor, and said learned correction value, an air-fuel ratio correction quantity computation step for computing a resultant air-fuel ratio correction quantity based on said first air-fuel ratio correction quantity and said second air-fuel ratio correction quantity, a catalytic converter condition judgement step for determining if the exhaust gas purifying catalytic converter is in an active condition, a learned correction value storage control step for storing said learned correction value for each operation region in a catalytic converter inactive storage means, when judged by said catalytic converter condition judgement step that the exhaust gas purifying catalytic converter is not in an active condition, and for storing said learned correction value for each operation region in a catalytic converter active storage means, when judged by said catalytic converter condition judgement step that the exhaust gas purifying catalytic converter is in an active condition, and a learned correction value selection step for selecting as a learned correction value for use in said second air-fuel ratio correction quantity computation step, a learned correction value stored in said catalytic converter inactive storage means, when judged by said catalytic converter condition judgement step that said exhaust gas purifying catalytic converter is not in an active condition, or a learned correction value stored in said catalytic converter active storage means, when judged by said catalytic converter condition judgement step that said exhaust gas purifying catalytic converter is in an active condition.

2. A method of controlling the air-fuel ratio of an internal combustion engine, said method comprising;

a first air-fuel ratio detection step for detecting air-fuel ratio using a first air-fuel ratio sensor an output value of which changes in response to a concentration of specific gaseous components in an exhaust gas, said concentration changing with air-fuel ratio in an exhaust passage upstream of an exhaust gas purifying catalyst device provided in an exhaust passage of the internal combustion engine, a second air-fuel ratio detection step for detecting air-fuel ratio using a second air-fuel ratio sensor an output value of which changes in response to a concentration of specific gaseous components in an exhaust gas, said concentration changing with air-fuel ratio in an exhaust passage downstream of said exhaust gas purifying catalyst device, a first air-fuel ratio correction quantity computation step for computing a first air-fuel ratio correction quantity corresponding to an output value from said first air-fuel ratio sensor, a learned correction value computation step for updating a learned correction value, based on a comparison of an output value from said second air-fuel ratio sensor and a reference value, a learned correction value storage control step for storing said learned correction value for each operation region in a storage means, a second air-fuel ratio correction quantity computation step for computing a second air-fuel ratio correction quantity corresponding to said output value from said second air-fuel ratio sensor, and said learned correction value stored in said storage means, an air-fuel ratio correction quantity computation step for computing a resultant air-fuel ratio correction quantity based on said first air-fuel ratio correction quantity and said second air-fuel ratio correction quantity, a catalytic converter condition judgement step for determining if the exhaust gas purifying catalytic converter is in an active condition, and a reference value modifying step for modifying the comparison reference value used in the learned correction value computation step towards the air-fuel ratio rich side when judged by the catalytic converter condition judgement step that the exhaust gas purifying catalytic converter is not in an active condition.

3. A method of controlling the air-fuel ratio of an internal combustion engine according to claim 1, wherein said catalytic converter condition judgement step comprises, a step for detecting an output fluctuation range of said second air-fuel ratio sensor, and a step for judging if the exhaust gas purifying catalytic converter has attained an active condition, based on said output fluctuation range detected by said output fluctuation range detection step.

4. A method of controlling the air-fuel ratio of an internal combustion engine according to claim 1, wherein said catalytic converter condition judgement step judges if the exhaust gas purifying catalytic converter is active, based on an air-fuel ratio lean side output value from said second air-fuel ratio sensor.

5. An apparatus for controlling the air-fuel ratio of an internal combustion engine, said apparatus comprising;

first air-fuel ratio detection means for detecting air-fuel ratio using a first air-fuel ratio sensor an output value of which changes in response to a concentration of specific gaseous components in an exhaust gas, said concentration changing with air-fuel ratio in an exhaust passage upstream of an exhaust gas purifying catalyst device provided in an exhaust passage of the internal combustion engine, second air-fuel ratio detection means for detecting air-fuel ratio using a second air-fuel ratio sensor an output value of which changes in response to an concentration of specific gaseous components in an exhaust gas, said concentration changing with air-fuel ratio in an exhaust passage downstream of said exhaust gas purifying catalyst device, first air-fuel ratio correction quantity computation means for computing a first air-fuel ratio correction quantity corresponding to an output value from said first air-fuel ratio sensor, learned correction value computation means for updating a learned correction value, based on a comparison of an output value from said second air-fuel ratio sensor and a reference value, second air-fuel ratio correction quantity computation means for computing a second air-fuel ratio correction quantity corresponding to said output value from said second air-fuel ratio sensor, and said learned correction value, air-fuel ratio correction quantity computation means for computing a resultant air-fuel ratio correction quantity based on said first air-fuel ratio correction quantity and said second air-fuel ratio correction quantity, catalytic converter condition judgement means for determining if the exhaust gas purifying catalytic converter is in an active condition, learned correction value storage control means for storing said learned correction value for each operation region in a catalytic converter inactive storage means, when judged by said catalytic converter condition judgement means that the exhaust gas purifying catalytic converter is not in an active condition, and for storing said learned correction value for each operation region in a catalytic converter active storage means, when judged by said catalytic converter condition judgement means that the exhaust gas purifying catalytic converter is in an active condition, and learned correction value selection means for selecting as a learned correction value for use in said second air-fuel ratio correction quantity computation means, a learned correction value stored in said catalytic converter inactive storage means, when judged by said catalytic converter condition judgement means that said exhaust gas purifying catalytic converter is not in an active condition, or a learned correction value stored in said catalytic converter active storage means, when judged by said catalytic converter condition judgement means that said exhaust gas purifying catalytic converter is in an active condition.

6. An apparatus for controlling the air-fuel ratio of an internal combustion engine, said apparatus comprising;

first air-fuel ratio detection means for detecting air-fuel ratio using a first air-fuel ratio sensor an output value of which changes in response to a concentration of specific gaseous components in an exhaust gas, said concentration changing with air-fuel ratio in an exhaust passage upstream of an exhaust gas purifying catalyst device provided in an exhaust passage of the internal combustion engine, second air-fuel ratio detection means for detecting air-fuel ratio using a second air-fuel ratio sensor an output value of which changes in response to an concentration of specific gaseous components in an exhaust gas, said concentration changing with air-fuel ratio in an exhaust passage downstream of said exhaust gas purifying catalyst device, first air-fuel ratio correction quantity computation means for computing a first air-fuel ratio correction quantity corresponding to an output value from said first air-fuel ratio sensor, learned correction value computation means for updating a learned correction value, based on a comparison of an output value from said second air-fuel ratio sensor and a reference value, learned correction value storage control means for storing said learned correction value for each operation region in a storage means, second air-fuel ratio correction quantity computation means for computing a second air-fuel ratio correction quantity corresponding to said output value from said second air-fuel ratio sensor, and said learned correction value stored in said storage means, air-fuel ratio correction quantity computation means for computing a resultant air-fuel ratio correction quantity based on said first air-fuel ratio correction quantity and said second air-fuel ratio correction quantity, catalytic converter condition judgement means for determining if the exhaust gas purifying catalytic converter is in an active condition, and reference value modifying means for modifying the comparison reference value used in the learned correction value computation means when towards the air-fuel ratio rich side judged by the catalytic converter condition judgement means that the exhaust gas purifying catalytic converter is not in an active condition.

7. An apparatus for controlling the air-fuel ratio of an internal combustion engine according to claim 5, wherein said catalytic converter condition judgement means comprises, means for detecting an output fluctuation range of said second air-fuel ratio sensor, and means for judging if the exhaust gas purifying catalytic converter has attained an active condition, based on said output fluctuation range detected by said output fluctuation range detection means.

8. An apparatus for controlling the air-fuel ratio of an internal combustion engine according to claim 5, wherein said catalytic converter condition judgement means judges if the exhaust gas purifying catalytic converter is active, based on an air-fuel ratio lean side output value from said second air-fuel ratio sensor.

9. A method of controlling the air-fuel ratio of an internal combustion engine according to claim 2, wherein said catalytic converter condition judgement step comprises, a step for detecting an output fluctuation range of said second air-fuel ratio sensor, and a step for judging if the exhaust gas purifying catalytic converter has attained an active condition, based on said output fluctuation range detected by said output fluctuation range detection step.

10. A method of controlling the air-fuel ratio of an internal combustion engine according to claim 2, wherein said catalytic converter condition judgement step judges if the exhaust gas purifying catalytic converter is active, based on an air-fuel ratio lean side output value from said second air-fuel ratio sensor.

11. An apparatus for controlling the air-fuel ratio of an internal combustion engine according to claim 6, wherein said catalytic converter condition judgement means comprises, means for detecting an output fluctuation range of said second air-fuel ratio sensor, and means for judging if the exhaust gas purifying catalytic converter has attained an active condition, based on said output fluctuation range detected by said output fluctuation range detection means.

12. An apparatus for controlling the air-fuel ratio of an internal combustion engine according to claim 6, wherein said catalytic converter condition judgement means judges if the exhaust gas purifying catalytic converter is active, based on an air-fuel ratio lean side output value from said second air-fuel ratio sensor.

* * * * *